US006247251B1

(12) United States Patent
James

(10) Patent No.: US 6,247,251 B1
(45) Date of Patent: Jun. 19, 2001

(54) GRIND PLATE WITH REMOVABLE INSERTS

(75) Inventor: Brent James, Manhattan Beach, CA (US)

(73) Assignee: Artemis Innovations Inc., Torrance, CA (US)

( * ) Notice: Subject to any disclaimer, the term of this patent is extended or adjusted under 35 U.S.C. 154(b) by 0 days.

(21) Appl. No.: 09/494,137

(22) Filed: Jan. 28, 2000

(51) Int. Cl.[7] ..... A43B 5/00

(52) U.S. Cl. ..... 36/115; 36/100; 36/15; 36/25 R

(58) Field of Search ..... 36/28, 100, 107, 36/108, 115, 15, 25 R, 72 A, 73

(56) References Cited

U.S. PATENT DOCUMENTS

| | | | | |
|---|---|---|---|---|
| 202,191 | | 4/1878 | Proctor . | |
| 234,030 | | 11/1880 | Hadley et al. . | |
| 579,577 | | 3/1897 | Hanscom . | |
| 702,476 | | 6/1902 | Price . | |
| 875,560 | | 12/1907 | Vaughan . | |
| 881,901 | | 3/1908 | Jolitz . | |
| 1,051,880 | | 2/1913 | Glenn . | |
| 1,056,091 | | 3/1913 | Dickson . | |
| 1,260,901 | | 3/1918 | Hayhurst . | |
| 1,592,692 | | 7/1926 | Hackett . | |
| 1,702,591 | | 2/1929 | Brown . | |
| 2,484,935 | | 10/1949 | De Rooy . | |
| 3,934,359 | | 1/1976 | Fletcher . | |
| 4,680,875 | * | 7/1987 | Danieli | 36/25 R |
| 4,691,453 | | 9/1987 | Tifre . | |
| 5,249,376 | | 10/1993 | Capria . | |
| 5,319,866 | | 6/1994 | Foley et al. . | |
| 5,367,791 | * | 11/1994 | Gross et al. | 36/25 R |
| 5,388,350 | | 2/1995 | Parker . | |
| 5,392,537 | | 2/1995 | Goldberg . | |
| 5,410,821 | | 5/1995 | Hilgendorf . | |
| 5,638,614 | | 6/1997 | Hardy . | |
| 5,797,199 | * | 8/1998 | Miller et al. | 36/28 |
| 5,815,949 | * | 10/1998 | Sessa | 36/28 |
| 5,970,631 | | 10/1999 | Inman . | |
| 6,006,450 | | 12/1999 | Hayes . | |
| 6,006,451 | | 12/1999 | Morris et al. . | |
| 6,023,859 | * | 2/2000 | Burke et al. | 36/100 |
| 6,041,525 | | 3/2000 | Kelley . | |

FOREIGN PATENT DOCUMENTS

| | | |
|---|---|---|
| 216903 | 1/1925 | (GB) . |
| PCT/US98/01051 | 1/1998 | (WO) . |

* cited by examiner

*Primary Examiner*—M. D. Patterson
(74) *Attorney, Agent, or Firm*—Fulwider Patton Lee & Utecht

(57) ABSTRACT

A grind shoe apparatus incorporating a variable friction grind plate complementally received in the recess of the shoe sole and having a downwardly facing trough and an outwardly facing rail with respective slide surfaces for contacting a support surface to slide therealong. Such plate further includes at least one speed control compartment positioned within one of such slide surfaces and having an insert removably carried therein for varying the frictional resistance occurring during sliding maneuvers.

26 Claims, 2 Drawing Sheets

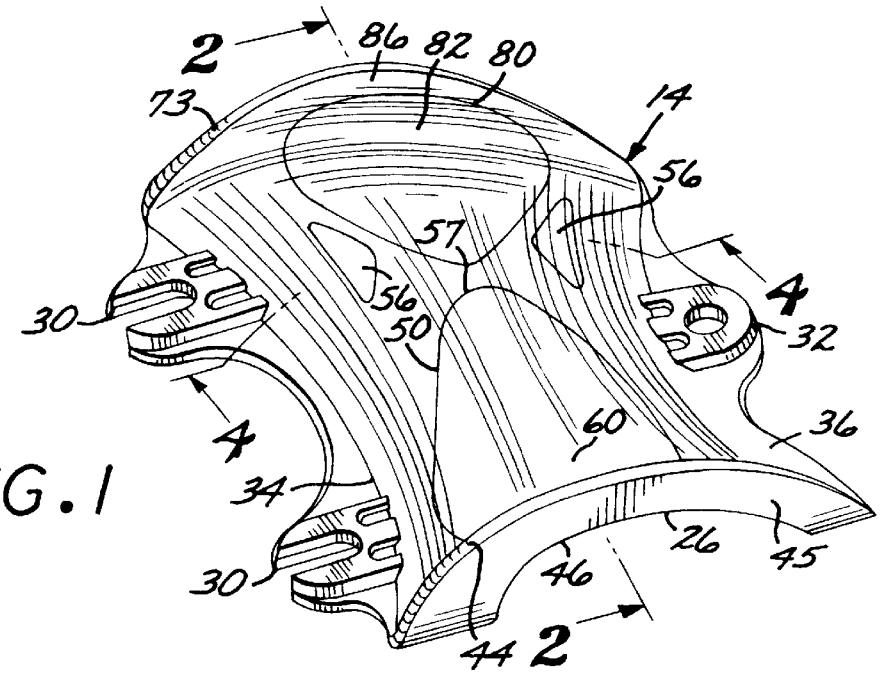
FIG. 1
FIG. 2
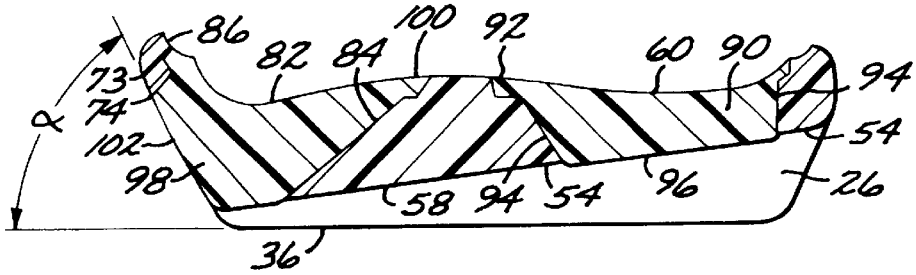
FIG. 3
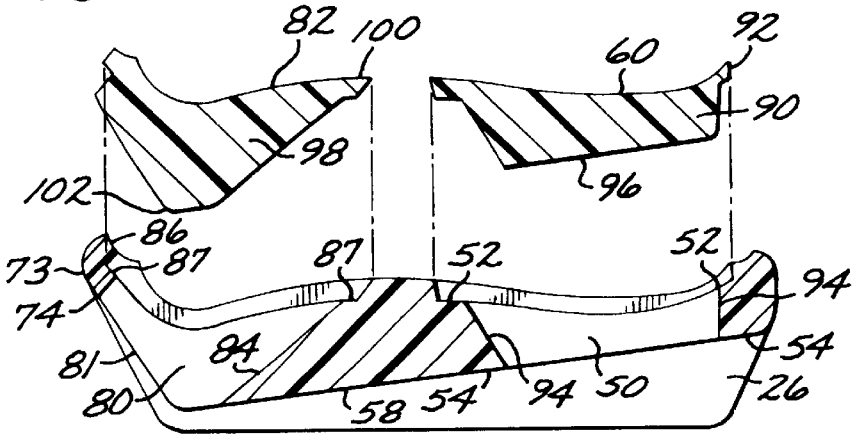

GRIND PLATE WITH REMOVABLE INSERTS

BACKGROUND OF THE INVENTION

1. Field of the Invention

The present invention relates generally to articles of footwear, and more specifically to articles of footwear adapted to slide over elongated support surfaces.

2. Description of the Prior Art

One activity enjoyed primarily by today's youth is using in-line skates or skateboards to drive the metallic or wooden bottom surface of such equipment onto curbs, rails, or other manmade obstacles to slide therealong. The popularity of this activity, commonly referred to as "grinding", along with the burden of carrying or wearing such equipment led to the advance described in U.S. Pat. No. 6,006,451, assigned to the present applicant. Such patent generally describes athletic shoes incorporating a plate for performing similar and novel sliding maneuvers over rigid support surfaces commonly found in outdoor settings such as parking lots and walkways as well as obstacles provided in manmade skate parks. These shoes, sold under the brand name SOAP®, enable normal walking and running functions while incorporating a plate recessed upwardly from the bottom surface of the shoe sole for grinding along the rigid support surfaces as encountered on pipe railings, curb edges, and similar obstacles.

While this device has enjoyed considerable commercial success, athletes of all skill levels continue to insist on additional features such as grind plates with replaceable wear sections or variable frictional characteristics for riding on different surfaces or for different working areas of the plate to assist in speed control, especially over steeply inclined surfaces. Applicant's assignee has developed three separate approaches to such variable customer demand. One particular effort is described in U.S. Pat. No. 5,970,631. Disclosed is a grinding shoe apparatus which includes a grind plate carried from a backing plate embedded in the sole of a shoe. The grind plate includes a plurality of bores receiving movable grind elements formed with downwardly facing grind surfaces which may have different coefficients of friction. While such device is considered satisfactory for many grinding maneuvers, placement of additional frictional surfaces is desirable in other locations such as on the lateral sides of the plate where many grinders prefer to slide.

Another effort is described in U.S. Pat. No. 6,006,450, also owned by applicant. This device incorporates a wear resistant brake tab secured between the upper and the plate and having an abrasive surface to enable the grinder to roll over the shoe and contact the rail to slow down the speed of the slide. This device is primarily for protecting the upper against excessive wear and may require a significant amount of rolling prior to engagement with the support surface to provide a braking function.

A third effort found in U.S. Ser. No. 09/364,756, also assigned to applicant, is a grinding plate bonded to the shoe sole and including laterally spaced apart bearing surfaces positioned adjacent elevated braking surfaces that provide the desired speed control. Such braking surfaces incur a lot of wear and, when sufficiently worn, must be replaced along with the entire plate which may result in useful non-bearing surface material being discarded.

It has been found that select portions of the grinding plate where preferred sliding and braking occurs may incorporate removable inserts which have variable frictional characteristics to provide alternative speed control features and facilitate replacement of worn surfaces thereby avoiding replacement of the entire plate. It is those features to which the present invention is directed.

SUMMARY OF THE INVENTION

The grinding shoe apparatus of the present invention is generally characterized by a shoe sole having a recess with a predetermined configuration and a plate having variable frictional characteristics complementally received therein. The plate generally includes a primary sliding section and a secondary sliding section. At least one of such sections including an opening removably receiving a wear insert with a working surface having a different coefficient of friction than other portions of such sections and capable of being exposed for contacting a support surface such as a rail or curb edge. Additional openings and associated inserts are also contemplated.

BRIEF DESCRIPTION OF THE DRAWINGS

FIG. 1 is a perspective view of a grind plate for use under a left shoe in accordance with a preferred embodiment of the present in invention;

FIG. 2 is a transverse cross sectional view, in enlarged scale, taken along lines 2—2 as shown in FIG. 1;

FIG. 3 is an exploded view similar of the cross section shown in FIG. 2;

Numerous advantages and aspects of the invention will be apparent to those skilled in the art upon consideration of the following detailed description and attached drawing figures referenced therein.

DETAILED DESCRIPTION OF THE PREFERRED EMBODIMENT

Figure 6:
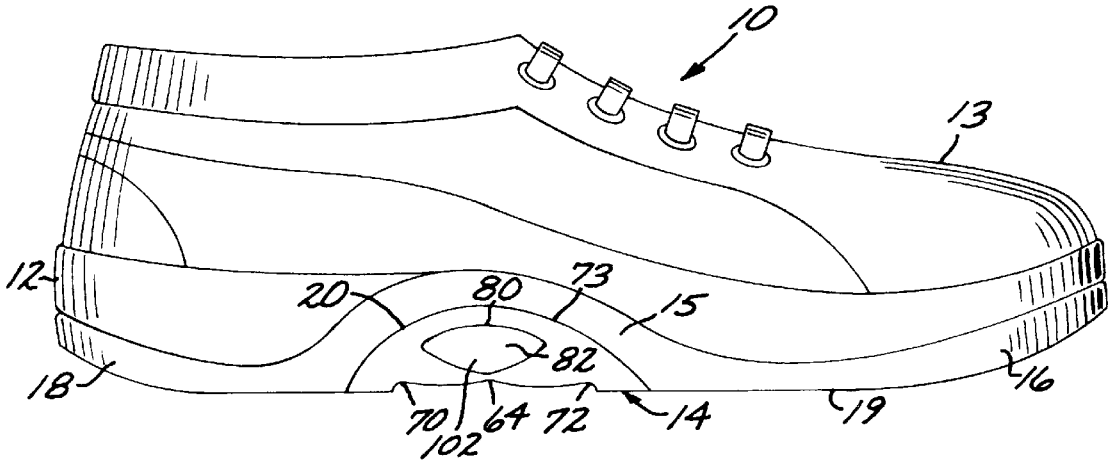
FIG. 6 is a right hand side view, in reduced scale, of the grind plate shown in FIG. 1 as incorporated into a representative article of footwear.

Referring now to FIGS. 1 and 6, a grind shoe apparatus, generally designated 10, is provided for sliding along elongated support surfaces such as rails, curb edges, and the like while allowing the athlete to control the speed of the slide. While the figures are generally directed to a left shoe, it will be appreciated that these principles apply equally to the right shoe as well. The shoe apparatus includes generally, a shoe sole 12, configured for receipt of an elongated grind plate, generally designated 14, and carrying removable inserts having surfaces for sliding and braking functions while such plate grinds over contacting support surfaces.

The sole 12 is attached to a conventional upper 13 by methods well known to those of ordinary skill in the art and consists of an outsole 15 including a spaced apart forefoot section 16 and a heel section 18 each terminating in a downwardly facing high friction tread surface 19. Interposed between the forefoot and heel sections substantially within the arch area of the shoe is an upwardly recessed wall 20 forming a cavity in the outsole 15. The cavity is generally preformed during the molding process of the sole with a preferable depth greater than the height of the plate such that installation of the plate positions its lowermost extremity above a horizontal plane passing through the tread surface. Consequently, the installed plate will not interfere with normal shoe functions such as walking and running. The cavity spans the entire width of the sole and also projects longitudinally within the arch area. Portions of the cavity project upwardly along the lateral and medial sides of the shoe to receive portions of the plate which wrap up onto the sides of the sole. The cavity is generally arcuately when viewed in longitudinal cross section. It will also be appreciated that the cavity could run generally longitudinally from the heel to the toe of the shoe and incorporate a plate therein for sliding along a direction parallel to such longitudinal cavity. It is preferred that the depth of the cavity wall is such that the lowermost extent of the plate 14 nested therein is about 6 mm above the tread surface 19. Other cavity shapes will also be apparent to those of ordinary skill in the art and not detract from the present invention.

The sole is generally formed of an elastomeric material and/or from a urethane-based substance commonly used in the industry. It is to be appreciated that other materials well known in the industry may also be used. However, it is preferable to use materials that will hold up under prolonged usage and provide some cushioning.

Figure 5:
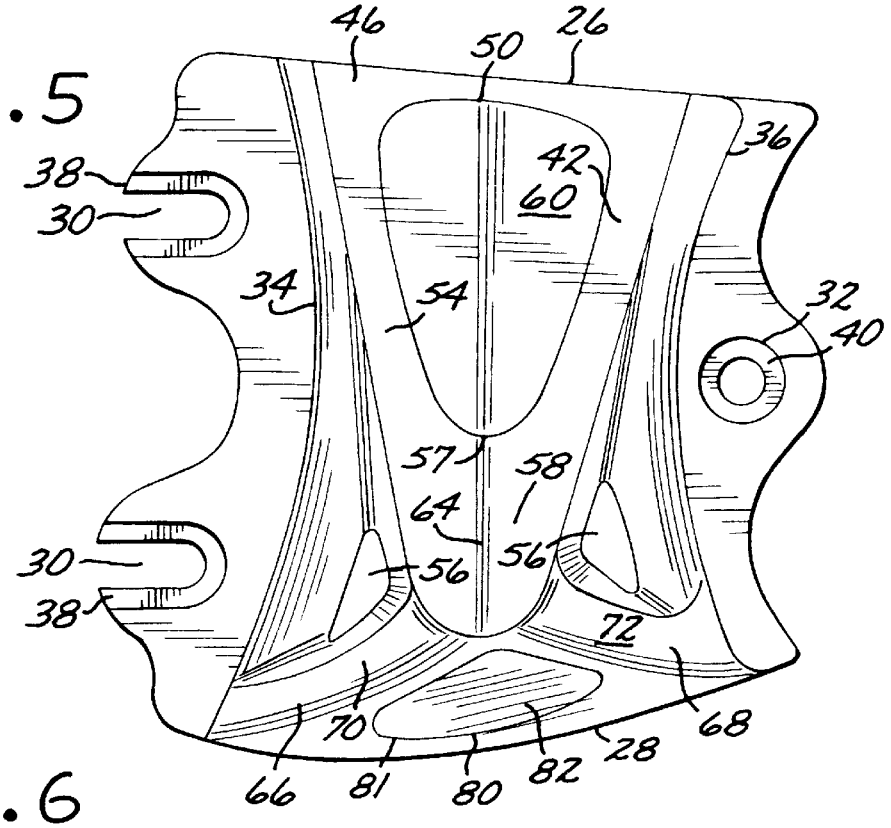
FIG. 5 is a bottom view, in enlarged scale, of the grind plate as shown in FIG. 1.

Referring now to FIGS. 1 and 5, the elongated grind plate 14 is generally a monolithic frame comprising a primary sliding section 26 and an adjacent primary braking section 28 with variable speed control features. The plate is typically injection molded from a rigid plastic such as Nylon 6 and constructed with an arcuate top surface overlying such sliding and braking sections to complementally abut the cavity wall 20 so that the plate rests directly against the cavity wall. The plate is preferably designed to be mechanically fastened to the sole to facilitate removal. Towards this end, the plate is formed with a pair of slotted fastener retainers 30 and an anchor bore 32 to cooperate with a set of equally numbered threaded fasteners (not shown) and threaded bores molded into the shoe sole to removably secure the plate. The elongated slotted fasteners 30 are spaced laterally apart and extend forwardly from a leading edge 34 of the plate. The slots are open ended so that any suitable mechanical fasteners used in conjunction with the slotted fasteners do not have to be completely removed from the sole of the shoe. The elongated construction of the slotted fasteners allows some relative movement between the plate and the fastener as the shoe is flexed particularly during running activities. The anchor bore extends rearwardly from a laterally centralized location of a trailing edge 36 of the plate. When viewed from below (FIG. 5), each slotted fastener includes a recessed ridge 38 and such anchor bore includes a counter bore 40 to reduce any profile of the fastener head. Such construction is substantially disclosed in our U.S. Pat. No. 6,006,451 and is herein incorporated by reference. Other suitable fasteners will occur to those of ordinary skill in the art.

With continued reference to FIGS. 1 and 5, the primary sliding section 26 of the plate extends transversely across the sole 12 and is generally arcuately shaped, when viewed in longitudinal cross section, to form a downwardly facing sliding trough 42 formed between the convexly outwardly curved leading 34 and trailing 36 edges. The curvature of such leading and trailing edges creates a closest point of convergence near the lateral center of the plate providing a relatively narrow throat section flanked by enlarged lateral and medial trough sections. When viewed from below, the primary sliding section is generally triangular shaped with an enlarged elongated lateral section forming an enlarged sliding area 46 projecting throughout the longitudinal length of the trough which diverges to a reduced sliding area on the medial side of the plate (FIG. 5). Within the enlarged sliding area 46 is a secondary speed control compartment 50 substantially longitudinally centered within the trough and defining an opening projecting through the plate 14 (FIG. 3). The secondary speed control compartment 50 is substantially triangularly shaped having three sides with the apex 57 of the compartment pointing toward the medial side of the plate. Where each of the three sides meet, the comers are rounded. Such secondary speed control compartment is positioned to coincide with a region expected to receive a high concentration of wear. As illustrated in FIGS. 2 and 3, when viewed in longitudinal cross section, the side walls 94 of the speed control compartment taper outwardly from the bottom to the top while the upper edge of such speed control compartment projects laterally to form a seat 52 to receive a complementally shaped secondary speed control insert 60 or slick plug.

Figure 4:
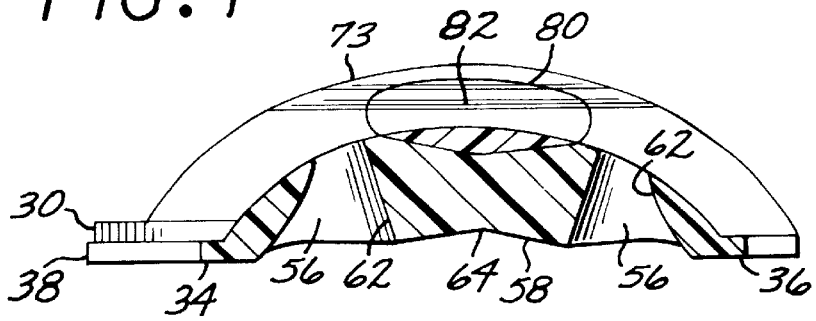
FIG. 4 is a longitudinal cross sectional view, in enlarged scale, taken along lines 4—4 in FIG. 1.

Surrounding the secondary speed control compartment 50 is a riding surface 54 overlying the support structure of the plate in the form of a triangle having its respective sides substantially aligned with those of the speed control compartment 50. Such riding surface provides a downwardly exposed slide surface with a preferred coefficient of friction selected for reducing the frictional resistance between the plate and the underlying support surface. Extending between the apex 57 of the secondary speed control compartment and the lowermost edge of the primary braking section 28 is a slide bridge 58 formed in the apex portion of the riding surface (FIGS. 2, 3, and 5). A transversely projecting central crease 64 is formed in the bridge 58. Such crease reduces the area of contact when the plate is abutting the contoured support surface such as a rail and assists in centering the plate on such rail. Such bridge forms a frequently used slide surface and typically includes a coefficient of friction similar to that incorporated into the riding surface. Positioned fore and aft of such transversely projecting bridge is a pair of recessed cutouts forming substantially triangular lightening through apertures 56 to reduce the overall weight of the plate 14. The sidewalls 62 of the recessed cutouts 56 are tapered inwardly from the bottom surface of the plate to the top (FIG. 4).

Referring back to FIG. 5, projecting longitudinally and outwardly from the sides of the slide bridge 58 is a forward strut 66 and a rearward strut 68 connecting the sides of such slide bridge with the medial side of the corresponding leading edge 34 or trailing edge 36. As viewed in FIG. 6, each contoured strut includes downwardly convex curvature to form a fore slide channel 70 and a rear slide channel 72. During most sliding maneuvers, the plate is generally centered on the crease 64 of the bridge 58, especially on larger diameter support surfaces. However, the incorporation of alternate slide channels enables the user to shift the plate longitudinally somewhat to center one of the respective channels over narrower support surfaces. Advantageously, this provides additional balance points for more acrobatic maneuvers. As viewed in FIG. 2, it can seen that the medial side of the slide bridge 58 is lower than the lateral side of the bridge such that a grinder could elevate the lateral side of the plate when sliding to slide primarily on the bridge 58 or the adjacent slide channels 70 and 72. This elevation across the plate 14 also provides additional stability by exposing a greater lateral surface sliding area to the underlying support surface when both sides of the plate are contacting the support surface or when riding along the lateral side of the plate. It has been found that this is a useful feature on flat and inclined surfaces.

With reference now to FIGS. 1–3, the secondary speed control insert 60 is constructed with a main body portion 90 projecting downwardly from a marginal retention flange 92 and terminating at is lowermost extremity in a downwardly facing bearing surface 96. The main body portion 90 is substantially triangular shaped and tapers inwardly from top to bottom to complement the shape of the inclined sidewalls 94 of the secondary speed control compartment 50. When installed in the speed control compartment, the marginal retention flange 92 is positioned to rest on the upper surface of the seat 52 and the main body portion is nested within the speed control compartment (FIG. 2). Thus, the speed control compartment removably retains the corresponding wear insert. It must be appreciated that this structural feature in combination with the tapering main portion 90 prevent the insert from falling through the compartment opening even as the insert is eventually worn down from repeated frictional contact with a support surface. Advantageously, this structure also enables the speed control insert 60 to be removably received in the speed control compartment 50 such that subsequent replacement is readily accommodated.

As illustrated in FIG. 2, it is preferable for the bearing surface 96 to extend below the surrounding riding surface 54 so that the grinder may engage such bearing surface on an underlying support surface. The degree of downward extension is in part dependent upon the hardness of the material selected. Material that wears more rapidly may require a greater extension below the riding surface. Typically, the bearing surface may be constructed of steel selected for its relatively low coefficient of friction and resistance to wear from frictional forces. Other materials including high density plastics may also be suitable as bearing surface or insert material. Such coefficient of friction is preferably selected to be lower than the surrounding riding surface 54 including the bridge 58 to provide the least frictional resistance of any portion of the plate. Thus, placement of the bearing surface 96 on an underlying pipe rail results in attaining the greatest amount of speed during the grinding maneuver. The entire insert may be made of the same material or alternatively only the projecting bearing surface is made of the relatively slick material. Additional application of slick coatings such as that sold under the tradename Teflon® over the bearing surface are preferably used to reduce frictional resistance even further if desired. Other suitable materials and coatings having relatively low coefficients of friction may also be incorporated. In some instances, it will be appreciated that it may be advantageous to incorporate a higher coefficient of friction into the primary wear insert 60. The advantages would include additional stopping power and may accommodate the preferences of some grinders who may prefer to use this downwardly facing surface as a brake.

With continued reference to FIGS. 1–2 and 6, when the insert 60 and plate 14 are installed on the shoe, the top surface of such speed control insert is preferably positioned to abut against the cavity wall 20 such that upward movement of the insert due to upward forces resulting from contact with the support rail is resisted. Such resistance maintains the bearing surface 96 below the riding surface 54 to enable the grinder to take full advantage of the slicker speed control insert surface to attain maximum speeds.

Referring now to FIGS. 2, 5, and 6, the braking section 28 of the plate 14 is formed in the upturned medial side of the trough 42. Such braking section turns upwardly and outwardly at an angle, as indicated by alpha, of about 60–75 degrees from a plane passing through the trailing edge 36 of the plate 14 to form a substantially crescent shaped, medial rail 73. For sliding purposes the medial rail 73 incorporates an outwardly facing medial track surface 74 which generally has a coefficient of friction greater than that of the riding surface 54. It is also preferable to incorporate a longitudinally positioned central indentation or crease (not shown) to assist the grinder in centering the braking rail 73 on the underlying rigid support surface such as a curb or pipe rail. Centrally positioned within the continuum of the medial track surface 74 is a primary speed control compartment 80 projecting inwardly from the medial track surface at an angle substantially perpendicular to alpha to define a substantially diamond shaped opening 81 with soft or rounded edges projecting through the plate for removable receipt of a primary braking insert 82 or primary speed control insert. Such opening is also positioned to coincide with an area expected high concentration of wear. The insert opening includes a lower inclined support surface 84 positioned to substantially overlie the slide bridge 58 and an opposing arcuate retention band 86 formed in the uppermost portion of the medial rail (FIG. 3). The periphery of the inclined support surface and retention band include a mounting seat 87 for abutting a portion of the braking insert 82.

As viewed in FIGS. 2, 3, and 6, the braking insert 82 includes brake body 98 projecting from a peripheral support flange 100 to terminate in a substantially diamond shaped, outwardly facing, working surface 102. The brake insert body 98 is constructed with a shape complementary to the primary speed control compartment 80 such that the braking insert 82 nests against and is sandwiched between the inclined support surface 84 and the retention band 86 when installed (FIG. 2). Furthermore, the peripheral support flange 100 abuts the mounting seat 87 to inhibit the brake insert from falling out the brake control compartment 80 even after extensive wear. When installed, the working surface 102 projects outwardly beyond a plane passing through the surrounding track surface 74 so that it may be driven into contact with a support surface to increase frictional resistance and thereby decrease the overall speed of the grinder. The top surface of the brake insert 82 as viewed in FIGS. 1 and 2 follows the contour of the top surface of the plate 14 to nest against the cavity wall 20 when installed. Such placement prevents the braking insert from moving inwardly when the working surface 102 contacts the underlying support surface so that the desired frictional contact is maintained.

For maximum braking control, the preferred material for the working surface 102 of the brake insert 82 is an injection molded plastic such as TPU selected for its resistance to wear while providing a relatively high coefficient of friction when compared to the surrounding medial track surface 74 and riding surfaces. Other materials such as those selected from the elastomer family such as rubber may also be suitable for use as a brake insert.

Referring now to FIGS. 1 and 2, another sliding surface may be incorporated into the present invention. Opposite the medial rail 73 and turning upwardly from the enlarged lateral side of the sliding trough 42 to nest against the lateral side of the outsole 15 is a lateral rail 44 which provides an outwardly facing sliding surface 45 and some lateral support for the shoe.

For purposes of illustration, the use of the present invention will begin with the assumption that the inserts are fully installed as viewed in FIG. 2 and the plate is secured to the sole as shown in FIG. 6. In use, a grinder dons a pair of shoes 10 incorporating the grind plate 14 of the present invention. It will be appreciated that because the plate is sufficiently recessed into the sole cavity 20 above the tread surface 19, the "grinder" may run or walk about in a normal manner without the plate interfering with such motion. Upon encountering a favorable support surface such as a rail, curb edge, stairs, or the like, the wearer approaches the support surface while building up speed and leaps to position the downwardly facing trough 42 on the support surface and engage either a portion of the riding surface 54 such as the bridge 58 or downwardly facing bearing surface 96 of the slick insert 60 on the rail to slide therealong. It will further be appreciated that the generally arcuate shape of the trough 42 and placement of the plate 14 substantially within the arch area of the shoe assists in centering the foot over the rail and improves the maintenance of the grinder's balance. The grinder then slides along such support using either gravity or momentum. Due to the absence of interference between the sole 15 and the plate 14, the grinder may slide in either transverse direction. Upon gaining additional experience the grinder may also reposition the plate to center the rigid support within either the fore slide channel 70 or aft slide channel 72 and slide on the respective struts 66 and 68. By alternating contact between the various sliding surfaces presented by the bridge 58, slick bearing surface 96, struts 66 and 68, and the rail, the grinder is able to select from a choice of speeds to vary the speed of the slide. For instance, the bearing surface 96 is generally coated with Teflon® for less kinetic friction and thus higher speeds may be attained. Reliance on the riding surface 54 under the slide bridge 58 with its relatively higher coefficient of friction results in a slightly reduced sliding rate. By rolling the foot about an axis substantially perpendicular to the direction of travel, the grinder may also contact the support with the lateral rail 44 and slide therealong.

When encountering rigid support surfaces, especially those with steeper inclines, it may be desirable to decrease the speed or least control the rate of acceleration of the slide for greater control and thus avoid situations where the grinder is either uncomfortable or the reduction in speed is necessary for a particular grinding maneuver or safety reasons. To achieve this greater degree of speed control, the grinder may simply roll either one or both feet about an axis projecting substantially perpendicularly to the direction of travel to engage the primary braking surface 28 of the respective medial rails 73. Extending one's leg away from the centerplane of one's body facilitates this rolling action. Such rolling action reduces or completely removes the contact between the slide surfaces within the primary slide section 26 and the support surface such that the grinder is primarily sliding along the support surface on the medial track surface 74 and the braking surface 102 of the brake insert 82. In most instances, only the braking surface 102 of the medial rail 73 of one shoe need be engaged to provide sufficient frictional resistance to control the speed or acceleration of the slide. In some maneuvers, the engaged braking surface is on the back foot relative to the direction of the slide. In other instances, the engaged braking surface is on the front foot relative to the direction of the travel. Contact between the abrasive or elastomeric braking surface 102 and the support combined with the weight of the grinder will provide sufficient frictional forces to reduce the sliding speed of the grinder. It will further be appreciated that the rigidity of the plate 14 assists in providing direct feedback of the slide speed to the feet of the wearer who adjusts balance accordingly. While sliding, the user may easily use the brakes of either shoe or both as desired.

It will appreciated that after extended use, the working surfaces of the respective brake insert 82 or slick insert 60 will eventually wear down even with or below the corresponding riding 54 or track 74 surfaces. However, the present invention, by incorporating removable primary wear surfaces results in a longer overall life for the plate 14 which generally wears down over longer period of time due to reduced contact time with any support surfaces. Excessive wear may be determined through a visual inspection of the working surfaces of the brake and slick inserts 82 and 60 which no longer extend beyond the planes passing through the respective riding and track surfaces 54 and 74. As previously described, the construction of the inserts and speed control compartments also inhibits the worn inserts from falling out of the plate.

At such time as excessive wear is determined, the grinder may elect to replace the slick 60 and brake 82 inserts instead of relying on other plate surfaces to slide on. The present invention easily accommodates such replacement. The wearer merely unfastens the plate 14 from the sole 12, for example, by using a conventional screwdriver or key (not shown) to unthread the threaded posts. The plate 14 is merely turned upside down as shown in FIG. 5 and the inserts will unseat and fall out. The plate is then righted and a new pair of inserts with the desired frictional characteristics is selected and placed in their corresponding speed control compartments 50 and 80. It will be appreciated that the degree of frictional resistance can be indicated by adding color to the inserts. For example, the brake insert 82 could be translucent while various shades of a solid color could indicate the lesser coefficients of friction of the secondary sliding insert 60. The differing shapes of the two speed control cavities and tapered sidewalls and seat facilitate the replacement of the two inserts and making it impossible to properly place the selected insert in the wrong speed control compartment. The plate is then refastened to the shoe sole and the wearer is then free to begin sliding with the new inserts.

While several forms of the present invention have been illustrated and described, it will also be apparent that various modifications may be made without departing from the spirit and scope of the invention. For instance, it will appreciated that materials of differing densities or hardnesses could be used to make the inserts or their respective working surfaces and thus present different frictional characteristics. As an example, increased braking from greater frictional resistance may be provided by using softer materials or more abrasive surfaces in the braking insert. Materials with lower coefficients of friction may be incorporated into the secondary sliding insert. Other materials such as plastics including TPU having different densities may be suitable for using to construct either the secondary wear insert 60 or the primary wear insert 82. It will also be appreciated that while incorporating a wear insert with a higher coefficient of friction to provide the desired braking as preferred in many circumstances, some grinders may also prefer that both inserts have equal coefficients of friction and are either equally slick or equally resistant to sliding. It should also be appreciated that different athletes may prefer to slide on different plate surfaces and that the function of the braking insert and secondary sliding insert may be interchangeable. The size of the inserts may be increased or decreased to provide a sufficient working surface for the desire sliding characteristics. Additionally, the projection of the working surfaces below the respective track and riding surfaces may be varied as necessary to provide longer mean time between insert replacement. While it is preferred that the respective working surfaces of the inserts project beyond the planes passing through their respective surrounding slide surfaces such that there respective working surfaces may be engaged immediately upon first use, it will be appreciated that the working surfaces may also planarly align with such slide surfaces or be recessed with respect to such slide surfaces.

Exposure of the working surfaces may occur after a portion of the surrounding slide surfaces are sufficiently worn down.

What is claimed is:

1. A grind shoe apparatus comprising:

a shoe sole formed with a downwardly opening recess of a predetermined configuration;

a variable friction grind plate complementally received in said recess and including a bottom surface forming a downwardly facing trough with a sliding surface having a predetermined coefficient of friction, said plate further including an upturned outwardly facing medial rail formed with an outwardly facing track surface, said rail configured with a speed control compartment opening into said track surface;

a removable primary speed control insert removably received in said speed control compartment and including a control surface projecting outwardly into said opening and having a coefficient of friction different than said predetermined coefficient of friction.

2. Grind shoe apparatus as set forth in claim 1 wherein:

said sliding surface is configured with a second speed control compartment opening into said sliding surface; and a secondary speed control insert removably received in said second speed control compartment and formed with a bearing surface projecting outwardly into said second speed control compartment opening and having a coefficient of friction different than said primary speed control insert.

3. Grind shoe apparatus as set forth in claim 1 wherein:

said primary speed control insert is formed of an elastomeric material.

4. Grind shoe apparatus as set forth in claim 1 wherein:

said medial track surface is substantially crescent shaped.

5. Grind shoe apparatus as set forth in claim 1 further including:

a first fastener projecting in multiple directions from said plate; and a second complementary fastener for securing said plate to said shoe.

6. Grind shoe apparatus as set forth in claim 1 wherein:

said plate is formed with an arcuately shaped top surface to be complementally received in said recess.

7. Grind shoe apparatus as set forth in claim 1 wherein:

said plate includes an upturned lateral slide rail.

8. Grind shoe apparatus as set forth in claim 1 wherein:

said sliding surface is connected to said medial upturned rail by a slide bridge.

9. Grind shoe apparatus as set forth in claim 1 wherein;

said bottom surface includes a pair of lightening apertures projecting through said plate.

10. Grind shoe apparatus as set forth in claim 1 wherein:

said trough includes convexly outwardly leading and trailing edges forming a flares on opposites transverse sides of said trough.

11. Grind shoe apparatus as set forth in claim 1 wherein:

said sliding surface has a greater surface area proximate the lateral side of said plate.

12. Grind shoe apparatus as set forth in claim 1 wherein:

said medial rail is angled outwardly about 60–75 degrees from a horizontal plane passing through the trailing edge of said plate.

13. Grind shoe apparatus as set forth in claim 2 wherein:

said secondary speed control insert is formed of a metallic material with a coefficient of friction less than said predetermined coefficient of friction.

14. Grind shoe apparatus as set forth in claim 2 wherein:

a coating overlying the lowermost extremity of said secondary speed control insert and selected to further reduce its coefficient of friction.

15. Grind shoe apparatus as set forth in claim 2 wherein:

said secondary speed control insert is substantially triangularly shaped when viewed in a horizontal plane.

16. Grind shoe apparatus as set forth in claim 8 wherein:

said bridge includes a transversely projecting centering crease.

17. Grind shoe apparatus as set forth in claim 8 wherein:

said plate includes a pair of struts forming downwardly convex slide channels on either side of said bridge.

18. Grind shoe apparatus as set forth in claim 1 wherein:

said speed control insert is formed with a peripheral mounting flange on its innermost extremity;

said speed control compartment is formed with a seat to cooperate with said peripheral mounting flange to prevent said insert from moving outwardly from said speed control compartment.

19. Grind shoe apparatus as set forth in claim 5 wherein:

said first fastener includes a pair of forwardly projecting spaced apart retainer prongs and a rearwardly projecting anchor bore; and said second fastener includes threaded posts.

20. Grind shoe apparatus as set forth in claim 1 wherein:

said control surface projects outwardly beyond a plane formed by said track surface.

21. Grind shoe apparatus as set forth in claim 2 wherein:

said bearing surface projects outwardly beyond a plane formed by said sliding surface.

22. Grind shoe apparatus as set forth in claim 1 wherein:

said coefficient of friction of said primary speed control insert is greater than said predetermined coefficient of friction.

23. Grind shoe apparatus as set forth in claim 2 wherein:

said coefficient of friction of said secondary speed control insert is less than said primary speed control insert coefficient of friction and less than said predetermined coefficient of friction.

24. Grind shoe apparatus as set forth in claim 1 wherein:

said sliding surface is substantially triangular with an enlarged lateral sliding area converging to a reduced medial sliding area adjacent said medial rail.

25. A grinding plate to be used with an article of footwear having a sole for sliding over an elongated support surface comprising:

a rigid, contoured plate formed with an arcuate top surface to be complementally received against the underneath of the sole and a bottom surface having a first section formed with a transversely projecting arcuate slide trough with a downwardly facing riding surface turning upwardly on one side to form an upturned lateral rail, said plate further including a second section having an opposing enlarged, outwardly facing, medial rail defining an outwardly facing track surface;

a first speed control compartment positioned within said first section and defining a substantially triangular through opening, when viewed in the horizontal plane relative to the bottom of said plate;

a second speed control compartment positioned within said second section and defining an inwardly projecting through hole projecting substantially perpendicularly to a plane passing through said medial rail;

a first slick insert constructed to be removably retained in said first speed control compartment and formed with a downwardly facing slide surface projecting below a plane passing through said riding surface;

a second braking insert constructed to be removably retained in said second speed control compartment and formed with an outwardly facing working surface projecting below a plane projecting through said track surface and having a higher coefficient of friction than said first insert;

each of said speed control compartments and respective said inserts constructed with cooperating tapered edges to inhibit said inserts from falling downwardly out of the respective said speed control compartments; and wherein said plate may be releasably secured to said sole and when in use, driven onto the support surface to slide therealong, and rotated about the support surface to engage either one of said inserts to vary the frictional resistance between said plate and the support surface.

26. Grind shoe apparatus as set forth in claim 1 wherein:

said sole is formed with said cavity wall recessed upwardly therein; and said plate is nested against said cavity wall.

* * * * *

UNITED STATES PATENT AND TRADEMARK OFFICE

CERTIFICATE OF CORRECTION

PATENT NO. : 6,247,251 B1
DATED : June 19, 2001
INVENTOR(S) : Brent James

It is certified that error appears in the above-identified patent and that said Letters Patent is hereby corrected as shown below:

Column 4,
Line 7, replace "comers" with -- corners --.
Line 64, replace "on flat" with -- on both flat --.

Signed and Sealed this

Fifteenth Day of January, 2002

*Attest:*

*Attesting Officer*

JAMES E. ROGAN
*Director of the United States Patent and Trademark Office*